US008141316B2

(12) United States Patent
Remin

(10) Patent No.: US 8,141,316 B2
(45) Date of Patent: Mar. 27, 2012

(54) PRE-FABRICATED CURVED PROFILE ARCHITECTURAL ELEMENT AND METHOD FOR PRE-FABRICATING THE SAME

(75) Inventor: Bradley Remin, Edmonton (CA)

(73) Assignee: Curved Walls, Inc., Edmonton (CA)

( * ) Notice: Subject to any disclaimer, the term of this patent is extended or adjusted under 35 U.S.C. 154(b) by 858 days.

(21) Appl. No.: 11/209,286

(22) Filed: Aug. 22, 2005

(65) Prior Publication Data

US 2006/0053713 A1 Mar. 16, 2006

(51) Int. Cl.
*E06B 1/04* (2006.01)

(52) U.S. Cl. ..... 52/631; 52/255; 52/85; 52/86; 428/426

(58) Field of Classification Search ..... 52/85, 86, 52/255, 287.1, 506.7, 631; 428/116
See application file for complete search history.

(56) References Cited

U.S. PATENT DOCUMENTS 3,654,053 A * 4/1972 Toedter ..... 428/56
3,731,449 A * 5/1973 Kephart, Jr. ..... 52/631
3,911,554 A * 10/1975 Ford ..... 29/527.2
4,402,170 A * 9/1983 Seidner ..... 52/631
4,704,837 A * 11/1987 Menchetti et al. ..... 52/631
5,045,374 A * 9/1991 Tucker ..... 428/83
5,096,060 A * 3/1992 Vavra ..... 206/320
5,137,752 A * 8/1992 Mills ..... 427/179
5,363,627 A * 11/1994 Wilson ..... 52/641
5,379,786 A * 1/1995 Lynam ..... 135/87
5,899,028 A * 5/1999 Warner ..... 52/80.2
6,047,512 A * 4/2000 Wendt et al. ..... 52/506.07
6,091,016 A * 7/2000 Kester ..... 136/245
6,183,836 B1 * 2/2001 Pflug ..... 428/116
6,212,836 B1 * 4/2001 Larson ..... 52/287.1
6,286,712 B1 * 9/2001 Craig et al. ..... 221/48
6,446,399 B1 9/2002 Lecours
6,722,087 B1 * 4/2004 Morello ..... 52/86
6,981,348 B2 * 1/2006 Kjorsvik ..... 52/85
2002/0023400 A1 * 2/2002 Smythe, Jr. ..... 52/287.1
2002/0035809 A1 * 3/2002 Smythe, Jr. ..... 52/255
2003/0000156 A1 * 1/2003 Morello et al. ..... 52/86
2004/0049999 A1 * 3/2004 Krieger ..... 52/245
2004/0093816 A1 * 5/2004 Smythe, Jr. ..... 52/255
2006/0053712 A1 * 3/2006 Norton ..... 52/287.1
2006/0174550 A1 * 8/2006 Smerud et al. ..... 52/86
2006/0184148 A1 * 8/2006 Butsch et al. ..... 604/367
2008/0057318 A1 * 3/2008 Adzima et al. ..... 428/426

OTHER PUBLICATIONS

Greenlaw, Bending Drywall, Mar./Apr. 2003, Carpenters.org; Direct link: http://www.carpenters.org/carpentermag/0203/TrdTik34_03.pdf.*
"PLAtec: Know-How," Avignon, France, <http://www.platec.com/en/know-how.html> [retrieved Nov. 22, 2008], 2 pages.

* cited by examiner

*Primary Examiner* — Richard E Chilcot, Jr.
*Assistant Examiner* — Alp Akbasli
(74) *Attorney, Agent, or Firm* — Christensen O'Connor Johnson Kindness PLLC

(57) ABSTRACT

A pre-fabricated architectural element and method of fabricating that same. A first step involves providing a piece of drywall having a first edge and a second end, the second edge being opposed to the first edge. A second step involves cutting two parallel ninety degree "V" grooves in a face of the piece of drywall. A third step involves folding a portion of the piece of drywall as dictated by the "V" grooves and securing the folded portion, thereby forming a square corner at the fold. A fourth step involves bending the piece of drywall to a desired radius of curvature.

8 Claims, 3 Drawing Sheets

PRE-FABRICATED CURVED PROFILE ARCHITECTURAL ELEMENT AND METHOD FOR PRE-FABRICATING THE SAME

FIELD OF THE INVENTION

The present invention relates to a pre-fabricated curved profile architectural element and a method for pre-fabricating such an architectural element.

BACKGROUND OF THE INVENTION

The term "pre-fabricated curved profile architectural element" encompasses: ceiling coves, wall coves, curved bulkheads, curved walls and various curved wall components. U.S. Pat. No. 6,446,399 (Lecours 2002) is an example of one technique used to pre-fabricate curved profile architectural elements.

Another technique known in the art is to bend two or more thin layers and build one layer on top of another until a desired curvature and thickness is obtained. A problem with such a layering technique is that it is impossible to form a square edge, as one layer invariably protrudes past the other layer. This leaves the architectural element with an edge having an unfinished appearance, necessitating further finishing steps on site by the end user. Bending a single layer of drywall with a laminated backer presents the problem of how to re-finish the edges to produce a finished product.

SUMMARY OF THE INVENTION

What is required is a pre-fabricated curved profile architectural element with a square edge and a method for pre-fabricating the same.

According to one aspect of the present invention there is provided a method of fabricating a curved profile architectural element. A first step involves providing a piece of drywall having a first edge and a second edge, the second edge being opposed to the first edge. A second step involves cutting two parallel ninety degree "V" grooves in a face of the piece of drywall. A third step involves folding a portion of the piece of drywall as dictated by the "V" grooves, thereby forming a square corner at the fold. A fourth step involves bending the piece of drywall to a desired radius of curvature.

According to another aspect of the present invention there is provided a pre-fabricated curved profile architectural element which includes a curved drywall body formed from a piece of drywall. The piece of drywall has a first face, a second face, a first edge and a second edge. A portion of the piece of drywall is folded as dictated by two side by side parallel ninety degree "V" grooves to form a square corner.

With the method, as described above, finished square corners can be formed on architectural elements.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
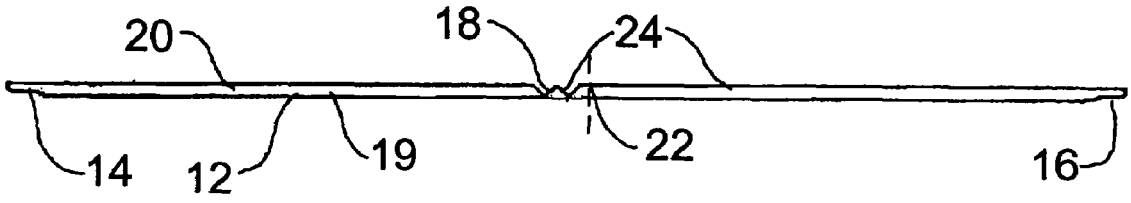
FIG. 1 is a side elevation view of a piece of drywall that has been prepared to be folded and bent in accordance with the teachings of the present invention.
Figure 2:
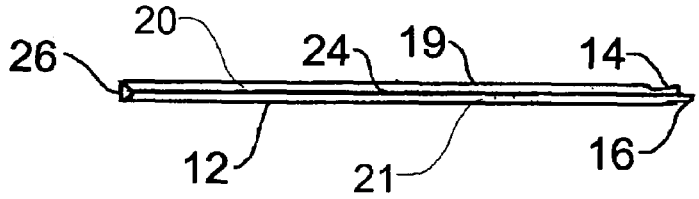
FIG. 2 is a side elevation view of the piece of drywall of FIG. 1 after folding.
Figure 3:
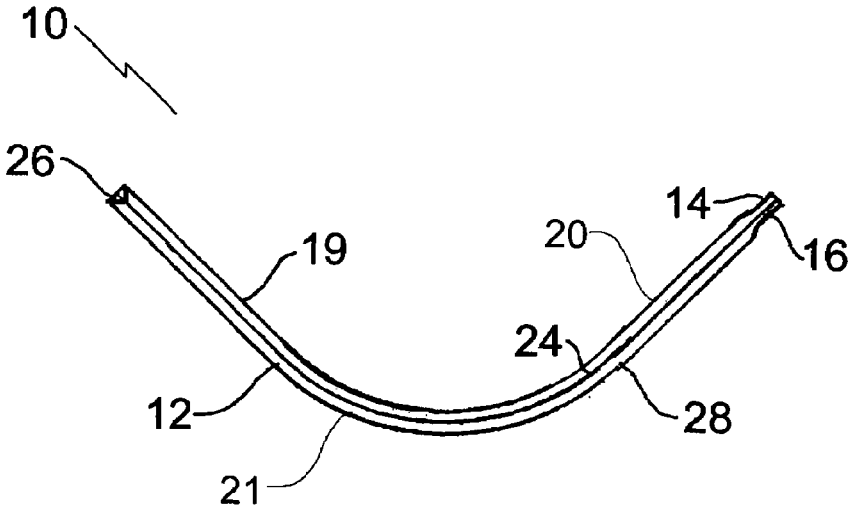
FIG. 3 is a side elevation view of the piece of drywall of FIG. 2 after bending.

The preferred method of fabricating a curved profile architectural element will now be described with reference to FIGS. 1 through 7. Referring to FIGS. 1 through 3, the preferred method can be used to produce a first embodiment of pre-fabricated curved profile architectural element, generally identified by reference numeral 10. Referring to FIGS. 4 through 7, the preferred method can be used to produce a second embodiment of pre-fabricated curved profile architectural element, generally identified by reference numeral 100.

FIGS. 1 through 3 show the process of preparing a product that is fire rated. Referring now to FIG. 1, the first step involves providing a piece of drywall 12 having a first edge 14 and a second edge 16 opposed to first edge 14. Two side by side parallel ninety degree "V" grooves 18 are cut in a face 20 of piece of drywall 12, where "V" grooves 18 are positioned between first edge 14 and second edge 16 just slightly offset from a central position 22 to accommodate alignment of the opposing edges after the bending process, and adhesive 24 is placed onto face 20 of piece of drywall 12. Referring now to FIG. 2, a portion 19 of piece of drywall 20 is folded over onto itself at a fold 26 dictated by "V" grooves 18, thereby forming a square corner at fold 26. Referring now to FIG. 3, piece of drywall 12 is then bent to a desired radius of curvature where the bend is started at the "V" grooves 18 at fold 26 and continuing around the radius. This will bring first edge 14 and second edge 16 of piece of drywall 12 into parallel alignment though bending. The bend is maintained until adhesive 24 sets to secure the folded portion 19 parallel to face 20 of piece of drywall 12, fixed in the desired radius of curvature, with first edge 14 and second edge 16 in parallel alignment to form pre-fabricated curved profile architectural element 10. As shown, pre-fabricated curved profile architectural element 10, includes a curved drywall body 28 formed from a single piece of drywall 12. Moisture is applied prior to bending to outer face 21 of piece of drywall 12, opposite face 20 and the bend is maintained until adhesive 24 sets.

Figure 4:
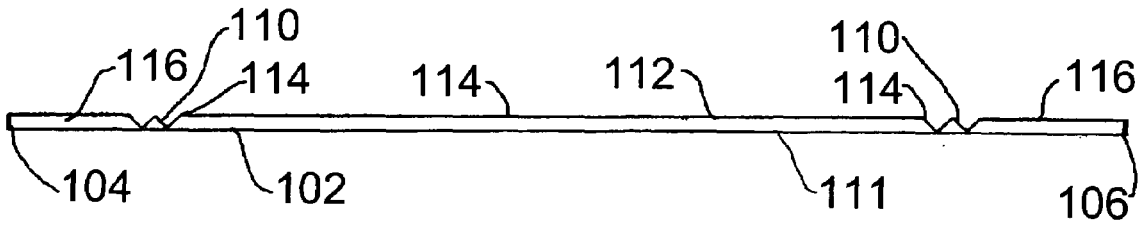
FIG. 4 is a side edge elevation view of a piece of drywall that has been prepared to be folded and bent in accordance with the teaching of the present invention.
Figure 5:
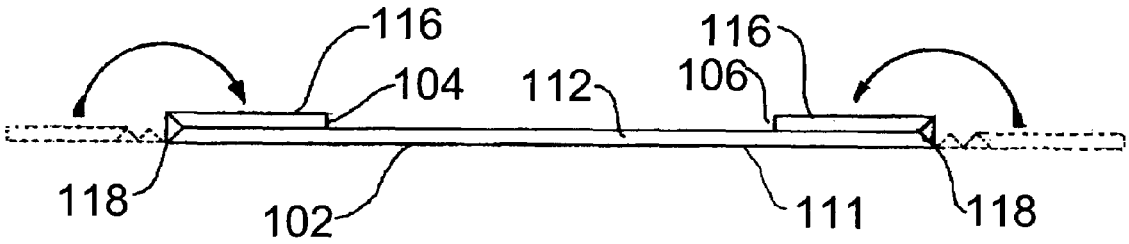
FIG. 5 is a side edge elevation view of the piece of drywall of FIG. 4, after folding.
Figure 6:
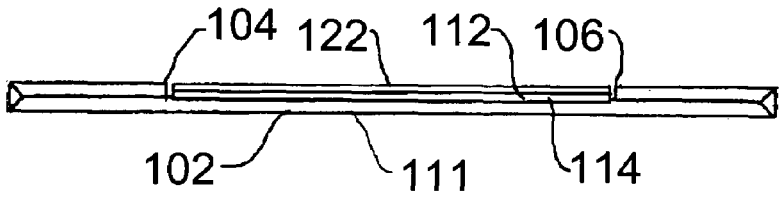
FIG. 6 is a side edge elevation view of the piece of drywall of FIG. 5, with a laminated backer board attached
Figure 7:
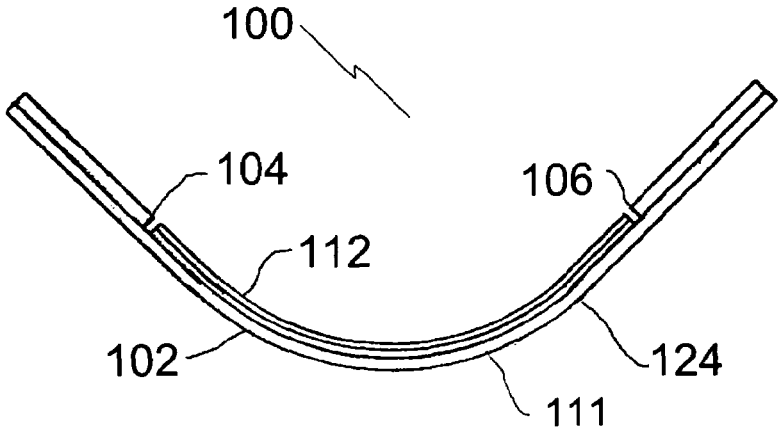
FIG. 7 is a side edge elevation view of the piece of drywall of FIG. 6, after bending.

FIGS. 4 through 7 show the process for a product that need not be fire rated. Referring now to FIG. 4, the first step involves providing a piece of drywall 102 having a first edge 104 and a second edge 106 opposed to first edge 104. Two sets of side by side parallel ninety degree "V" grooves 110 are cut in a face 112 of piece of drywall 102 spaced from each of the first 104 edge and the second edge 106, and adhesive 114 is applied in "V" grooves 110 and to face 112. Referring to FIG. 5, portions 116 of piece of drywall 102 are folded over onto itself at folds 118 dictated by "V" grooves 110 and folded portions 116 are secured parallel to face 112 of piece of drywall 102 with adhesive 114, thereby forming two opposed square corners at folds 118. Referring now to FIG. 6, a laminated backer board 122 is secured in a central position between the two folded portions 116 with adhesive 114. Referring to FIG. 7, piece of drywall 102 is then bent to a desired radius of curvature with the bend starting at the center of the desired radius. The bend is maintained until adhesive 114 sets to secure folded portions 116 parallel to face 112 of piece of drywall 102, and backer board 122 parallel to face 112 of piece of drywall 102 fixed in the desired radius of curvature. As shown, pre-fabricated curved profile architectural element 100 is thus formed having a curved drywall body 124 formed from piece of drywall 102.

Prior to bending, moisture is applied to face 111 of piece of drywall 102, opposite face 112. Moisture is applied to the piece of drywall 102 in an effort to make the gypsum core more pliable and therefore more condugve to being bent. Gypsum drywall, like many materials has a "memory", and after bending it wants to bend back to it original state. By adding moisture to the drywall, we make it more pliable. When the laminated backer board 122 is laminated to face 112 of piece of drywall 102, laminated backer board 122 holds the bent drywall 102 in the desired position and the penetrated moisture prevents "spring-back" caused by the "memory" in the board.

There are various materials which can be used for the backer board. One product which has been used successfully is a scored medium density fibreboard, sold under the Trade Mark "Bendy MDF". Another product which has been used successfully is a flexible core birch plywood with the grain oriented so the plywood will bend in one direction, sold under the Trade Mark "FlexCore".

Figure 8:
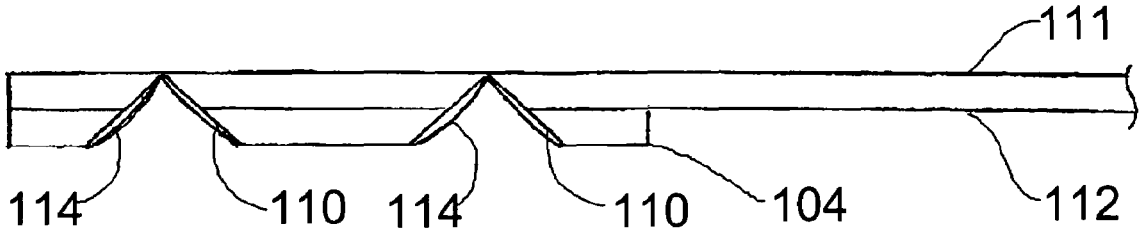
FIG. 8 is a side edge elevation view a piece of drywall that has been prepared to be folded in accordance with the teachings of the present invention, with different spagng between the "V" grooves.
Figure 9:
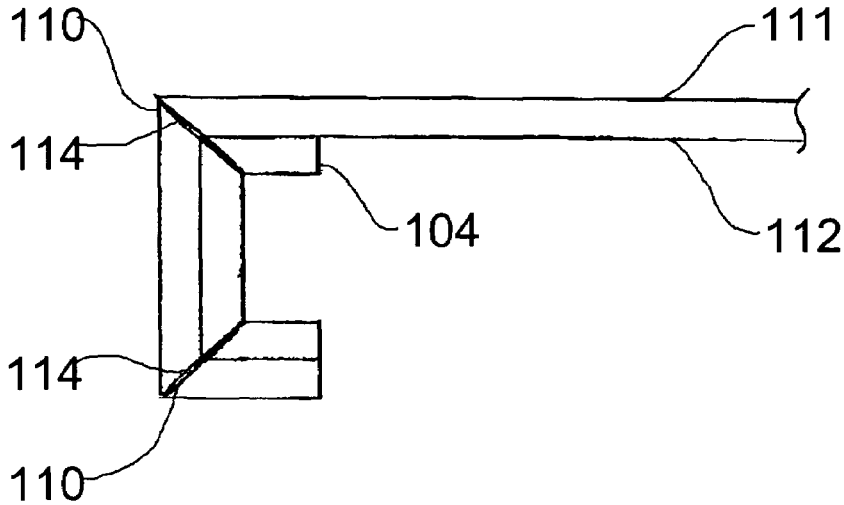
FIG. 9 is a side edge elevation view of the piece of drywall of FIG. 8, after bending.

Variations:

FIGS. 8 and 9 have been included in this application to demonstrate the effect of altering the spagng between "V" grooves 110. Identical reference numerals have been used for, apart from the spagng, the steps and components are identical. It can be seen from FIGS. 8 and 9, that by varying the spagng of "V" grooves 110, one may change the thickness of the resulting edge. Adhesive 114 is placed in the "V" grooves to secure drywall 102 in a folded position.

Cautionary Warnings:

One must form the bend in the architectural applying pressure equally along the radius of curvature. The greater extent to which pressure is unequal, the more it becomes likely that a failure will be experienced during bending.

In this patent document, the word "comprising" is used in its non-limiting sense to mean that items following the word are included, but items not spegfically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of fabricating a curved profile architectural element, comprising the steps of:

providing a piece of drywall having a first edge and a second edge, the second edge being opposed to the first edge;

cutting two parallel ninety degree "V" grooves in a face of the piece of drywall;

forming a square corner by folding a portion of the piece of drywall over onto itself as dictated by the "V" grooves so that the folded portion is parallel to the face and securing the folded portion to the central portion; and bending the piece of drywall to a desired radius of curvature by applying pressure equally along the radius of curvature, wherein the "V" grooves are positioned spaced from each of the first edge and the second edge, thereby forming two of the folded portions and two opposed square corners, and wherein a backer board is centrally positioned between the two folded portions.

2. The method as defined in claim 1, the folded portion being secured with adhesive.

3. The method as defined in claim 1, the "V" grooves being spaced from at least one of the first edge or the second edge.

4. The method of claim 1, further comprising the step of applying moisture to the piece of drywall prior to bending.

5. A method of fabricating a curved profile architectural element, comprising the steps of:

providing a piece of drywall having a first edge and a second edge, the second edge being opposed to the first edge;

cutting two parallel ninety degree "V" grooves in a face of the piece of drywall spaced from each of the first edge and the second edge;

forming two opposed square corners by folding portions of the piece of drywall over onto itself as dictated by the "V" grooves so that the folded portions are parallel to the face and securing the folded portions with adhesive to the central portion;

securing a backer board in a central position between the two folded portions with adhesive;

bending the piece of drywall to form a bend having a desired radius of curvature by applying pressure equally along the radius of curvature; and maintaining the bend until the adhesive sets and the backer board parallel to the face of the piece of drywall is fixed in the desired radius of curvature.

6. The method of claim 5, further comprising the step of applying moisture to the piece of drywall prior to bending.

7. A method of fabricating a curved profile architectural element, comprising the steps of:

providing a piece of drywall having a first edge and a second edge, the second edge being opposed to the first edge;

cutting two side by side parallel ninety degree "V" grooves in a face of the piece of drywall, the "V" grooves being positioned between the first edge and the second edge just slightly offset from a central position to accommodate bending;

placing adhesive onto the face of the piece of drywall;

forming a square corner by folding a portion of the piece of drywall over onto itself at a fold dictated by the "V" grooves so that the folded portion is parallel to the face;

bending the piece of drywall to form a bend having a desired radius of curvature by applying pressure equally along the radius of curvature with the first edge and the second edge of the piece of drywall being brought into parallel alignment through bending; and maintaining the bend until the adhesive sets to secure the folded portion parallel to the face of the piece of drywall, fixed in the desired radius of curvature, with the first edge and the second edge in parallel alignment.

8. The method of claim 7, further comprising the step of applying moisture to the piece of drywall prior to bending.

* * * * *